United States Patent [19]

Oda

[11] Patent Number: 4,501,620

[45] **Date of Patent: * Feb. 26, 1985**

[54] METHOD OF CLEANING A PHOTO-SENSITIVE BODY

[75] Inventor: Goro Oda, Tokyo, Japan

[73] Assignee: Tokyo Shibaura Denki Kabushiki Kaisha, Kawasaki, Japan

[ * ] Notice: The portion of the term of this patent subsequent to Dec. 21, 1999 has been disclaimed.

[21] Appl. No.: 368,816

[22] Filed: Apr. 15, 1982

Related U.S. Application Data

[62] Division of Ser. No. 152,313, May 22, 1980, Pat. No. 4,364,660.

[30] Foreign Application Priority Data

May 29, 1979 [JP] Japan ..... 54-65546
May 29, 1979 [JP] Japan ..... 54-65547
May 29, 1979 [JP] Japan ..... 54-65548

[51] Int. Cl.[3] ..... B08B 1/02

[52] U.S. Cl. ..... 134/6; 15/256.51; 15/256.53; 134/32; 355/15

[58] Field of Search ..... 355/15, 77; 15/256.5, 15/256.51, 256.53; 134/6, 32; 118/652

[56] References Cited

U.S. PATENT DOCUMENTS

| | | | |
|---|---|---|---|
| 3,792,925 | 2/1974 | Milligan et al. | 355/15 |
| 3,819,263 | 6/1974 | Draugelis et al. | 355/15 X |
| 3,848,992 | 11/1974 | Smith | 355/15 |
| 3,977,898 | 8/1976 | Hwa | 355/15 X |
| 4,131,359 | 12/1978 | Honda | 355/15 |
| 4,158,498 | 6/1979 | Ohmori | 355/15 |
| 4,174,172 | 11/1979 | Lane | 355/15 |

*Primary Examiner*—Marc L. Caroff
*Attorney, Agent, or Firm*—Cushman, Darby and Cushman

[57] ABSTRACT

Toner is removed from the surface of a drum coated with a photo-sensitive material by bringing a cleaning blade into contact with the surface when the drum is stationary, rotating the drum at a monotonically increasing rate of speed until a predetermined rotational speed is reached, monotonically increasing the contact pressure exerted by the blade against the drum surface while the drum speed is being increased so that the contact pressure reaches a maximum contact pressure when the drum reaches the predetermined rotational speed, and maintaining the maximum contact pressure while the drum continues rotating at the predetermined rotational speed.

5 Claims, 13 Drawing Figures

METHOD OF CLEANING A PHOTO-SENSITIVE BODY

This is a division of application Ser. No. 152,313 filed May 22, 1980, now U.S. Pat. No. 4,364,660.

BACKGROUND OF THE INVENTION

This invention relates to an apparatus for and a method of cleaning a photo-sensitive body and, more particularly, to an apparatus for and a method of cleaning a photo-sensitive body in a copying machine by removing the residual toner on the surface of a photo-sensitive body with a cleaning blade after completion of the image transfer onto a copying sheet.

Hitherto, efforts have been made to improve the operability and the maintainability of copying machines. Particularly, up to date there is a strong demand for miniaturizing and reducing costs of the copying machine. In order to meet this demand for miniatuarization and cost reduction, it has been proposed to use a platelike cleaning blade for a photo-sensitive material coated drum cleaning apparatus which serves to remove the residual toner remaining on a surface of the photo-sensitive material coated drum after completion of the image transfer operation.

In such a drum cleaning apparatus in which the cleaning blade is used, where the cleaning blade is at all times held in forced contact with the photo-sensitive body surface, the crystal structure of the photo-sensitive material is changed in quality to cause deterioration of the copied image. For the purpose of preventing this deterioration, various improvements have been proposed. For example, there has been proposed and widely accepted a two-position drive mechanism, in which, as shown in FIG. 1, a cleaning blade 11 is held spaced apart from the surface of the photo-sensitive material coated drum 10 when it is out of operation and, as shown in FIG. 2, is brought into forced contact with the surface of the drum 10 at the time of the commencement of the cleaning operation.

Further, in the light of the afore-mentioned demand for miniatuarization and cost reduction it has been proposed and widely accepted that a common drive source is used for either of the two-position drive mechanism for the cleaning blade 11 and a drive mechanism for the drum 10.

In this case, the cleaning blade 11 is instantaneously brought from its position spaced apart from the surface of the drum 10 into forced contact therewith at the time of commencement of rotation of the drum 10. Therefore, the cleaning blade 11 that strikes the surface of the drum 10 has a great impact. Particularly, the tip of the cleaning blade 11 is given with an extremely great impact at the moment when the tip strikes the drum surface, since the area of contact therebetween is narrow. Consequently, the tip of the cleaning blade 11 is likely to be turned up in the direction of rotation of the drum 10 or suffer other damages. When the cleaning blade 11 is thus damaged, it can no longer completely remove the residual toner on the drum surface. This causes the occurrence of what is called "the film-forming" phenomena, that is, the formation of a toner film on the drum surface.

When such a toner film is formed, as one problem, the image forming function of the relevant area of the drum 10 is reduced resulting in the deterioration of the image quality.

As another problem, since the drum 10 and cleaning blade 11 are driven by the common drive source, the drum 10 commences its rotation simultaneously with the commencement of the movement of the cleaning blade 11 from the position spaced apart from the surface of the drum 10 to the position at which the cleaning blade 11 is in forced contact with the drum 10. Therefore, some of the toner 12 on the drum surface has not been removed by the cleaning blade 11, as shown in FIG. 2, since the drum surface portion bearing such some toner is passed by under the same, before the cleaning blade 11 is brought into forced contact with the drum sruface. This toner 12 which is not removed is likely to fall from the drum surface or be scattered in the copying machine during the subsequent rotation of the drum 10. The falling or scattered toner contaminates internal component parts of the copying machine. Particularly, if the charger is contaminated, the image forming function becomes inferior.

To solve the afore-mentioned first problem, i.e., the damage of the cleaning blade 11, it may be thought to bring the cleaning blade 11 into forced contact with the drum 10 prior to the commencement of rotation of drum 10. However, even by so doing there is still a coefficient of static friction between the tip of the cleaning blade 11 which is already in contact with the drum surface at the time of commencement of rotation of the drum 10 and the surface thereof, so that the tip of the cleaning blade in contact with the drum experiences a considerable load. In other words, this arrangement cannot completely solve the problem that the tip of the cleaning blade 11 is liable to damage.

To solve the second problem, i.e., the falling or scattering of the toner left without being removed, it has been contemplated to drive the cleaning blade 11 independently by a separate drive source, for instance one using a solenoid, prior to the commencement of driving of the drum 10 with sacrifice in size. In this case, however, about 20 W of power has to be supplied to the solenoid for effectively bringing the tip of the cleaning blade 11 into forced contact with the drum 10. Therefore, the use of the solenoid as the drive source for the cleaning blade 11 does not only increase power consumption, which is undesired from the standpoint of economy, but also gives rise to other problems such as the necessity of separately providing a means for radiating heat generated in the solenoid.

SUMMARY OF THE INVENTION

This invention is intended in the light of the above affairs, and its object is to provide an apparatus for and a method of cleaning a photo-sensitive body, which can reliably clean the surface of a photo-sensitive body with a cleaning blade to permit copy images of a stable quality to be obtained and is also small in size and inexpensive.

According to an aspect of the present invention, there is provided a method of cleaning a photo-sensitive body, which comprises a first step of bringing a cleaning blade into contact with the surface of a photo-sensitive body before the start of operation of said photo-sentitive body, and a second step of gradually increasing the contact pressure applied to the surface of the photo-sensitive body by said cleaning blade in contact with said surface to render said cleaning blade into a state ready for cleaning the toner remaining attached to the surface of said photo-sensitive body in an initial stage of the operation of said photo-sensitive body.

According to another aspect of the invention, there is provided an apparatus for cleaning a photo-sensitive body which comprises a cleaning blade contactable with respect to the surface of the photo-sensitive body, and a drive mechanism for moving said cleaning blade to be contacted with the surface of said photo-sensitive body before the start of the operation of said photo-sensitive body and to subsequently cause the contact pressure applied to the surface of said photo-sensitive body by said cleaning blade in contact therewith to be gradually increased in an intial stage of the operation of said photo-sensitive body.

BRIEF DESCRIPTION OF THE DRAWINGS

FIGS. 1 to 3 show a prior-art apparatus for cleaning a photo-sensitive body, wherein FIG. 1 is a fragmentary sectional view showing the apparatus in an inoperative state, FIG. 2 is a view similar to FIG. 1 but showing the apparatus in an operative state, and FIG. 3 is a schematic side view showing the positional relation between a photo-sensitive body and a cleaning blade of the apparatus;

FIGS. 4 to 10 show an embodiment of the apparatus for cleaning a photo-sensitive body according to the invention, wherein FIG. 4 is a transversal sectional view showing the apparatus in an inoperative state, FIG. 5 is a view similar to FIG. 4 but showing the apparatus in a state at the instant of start of the cleaning opration, FIG. 6 is a view similar to FIG. 4 but showing the apparatus in an operative state, FIG. 7 is a fragmentary axial sectional view showing a drive mechanism of the apparatus, FIG. 8 is a schematic sectional view of the drive mechanism of FIG. 7 looking in the same direction as in FIGS. 4 to 6, FIG. 9 is a fragmentary enlarged-scale sectional view of the apparatus looked in the same direction as in FIG. 8 showing the operation of a spring clutch at the time when the apparatus is brought from the operative state to the inopertive state, and FIG. 10 is a view similar to FIG. 9 but showing the operation of the spring clutch at the time when the apparatus is brought from the inoperative state to the oprative state.

DETAILED DESCRIPTION OF THE PREFERRED EMBODIMENTS:

Now, an embodiment of the invention to be applied to a copying machine will be described with reference to FIGS. 4 to 10 of the accompanying drawings.

Figure 1:
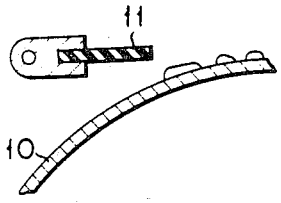
FIG. 1 Prior Art
Figure 2:
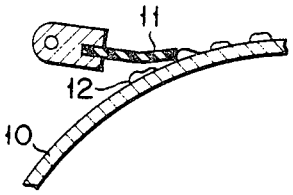
FIG. 2 Prior Art
Figure 3:
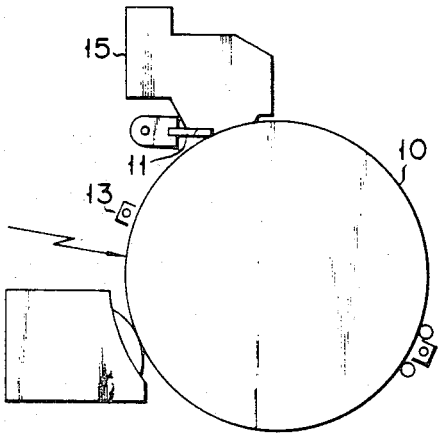
FIG. 3 Prior Art
Figure 4:
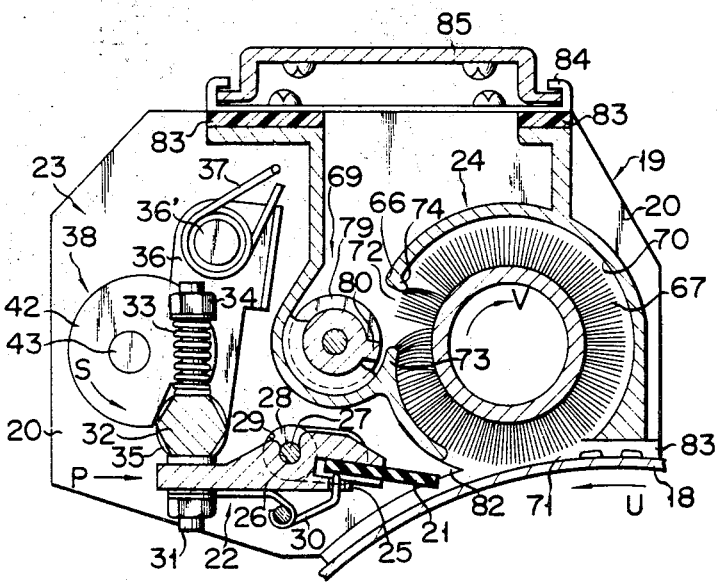

As shown in FIG. 4 an apparatus 19 for cleaning a photo-sensitive material coated drum 18 is disposed as a unit above and facing the surface of the photo-sensitive material coated drum 18 which rotates in the counter-clockwise direction as shown by arrow U. The drum cleaning apparatus 19 comprises a frame 20 supporting the whole apparatus, a cleaning blade 21 provided so that it can be brought into contact with and separated from the surface of the drum 18, a blade holder mechanism 22 supporting movably the cleaning blade 21, a drive mechanism 23 for moving the blade holder mechanism 22 and a toner recovery mechanism 24 for collecting the toner removed from the surface of the drum 18.

The cleaning blade 21 is made of soft rubber, and is provided extending substantially horizontally forward of that position of the drum surface which is deviated slightly downwards and in the rotating direction of the drum 18 from the top of the surface of the photo-sensitive material coated drum 18, and at which it is contactible with the corresponding drum surface as need arises. The cleaning blade 21 is mounted in the blade holder mechanism 22 such that it forms a predetermined acute angle measured in the clockwise direction with the tangential to the drum 18 at the point of its contact therewith.

The blade holder mechanism 22 includes a support body 25, in which the cleaning blade 21 is mounted for movement in unison with the support body 25. The support body 25 is provided substantially in its central portion with a roller shaft bearing 26 in the form of a recess. In the roller shaft bearing 26 a central portion of a roller shaft 27 is rotatably received, and the roller shaft 27 carries rollers 28 mounted at its opposite ends. Each of the rollers 28 is inserted in a substantially horizontal guide slot 29 formed in each of the side walls of the frame 20, one of these side walls being not shown. A pin 30 supporting the underside of the cleaning blade 21 is provided on the underside of the support body 25. Secured to the other end of the support body 25 is a supporting shaft 31 which extends upwards. A shaft guide 32 is slidably fitted on a portion of the supporting shaft 31 adjacent to the support body 25. A compression spring 33 for adjusting the balance of the contact of the cleaning blade 21 with the surface of the drum 18 is fitted on an upper portion of the support shaft 31 extending above the shaft guide 32, with its one end in engagement with one end of the shaft guide 32 and its other end in engagement with a nut 34 provided on the uppermost end of the support shaft 31. The nut 34 serves as a retainer to prevent the detachment of the compression spring 33 from the support shaft 31. The shaft guide 32 carries bush rollers 35 rotatably mounted on its opposite ends. The shaft supporting the bush rollers 35, i.e., each end portion of the shaft guide 32, is inserted and rotatably supported in each hole formed in each end portion of a pair of bracket 36. The bracket 36 is rotatably mounted on a shaft 36' which is secured to the frame 20, and is biased by a spring 37 in the clockwise direction about the shaft 36' in the Figure. With the biasing force of the spring 37 the bush rollers 35 are normally held in forced contact with the cam surface of a cam member 42 as will be described later in detail.

The drive mechanism 23 which drives the blade holder mechanism 22 includes a cam mechanism 38 serving as a pressure control mechanism for controlling the pressure of contact between the cleaning blade 21 and photo-sensitive material coated drum 18, a timing control mechanism 39 for controlling the timing of the start of movement of the cleaning blade 21, a gear 40 serving as drive source for the cam mechanism 38 and a spring clutch mechanism 41 serving as drive force transmitting mechanism for transmitting the drive force from the gear 40 to the cam mechanism 38.

The cam mechanism 38 includes a cam member 42 having a peripheral surface serving as cam surface, with which the bush roller 35 of the blade holder mechanism 22 engages, and a cam shaft 43 carrying the cam member 42 secured to one end thereof. The opposite ends of the cam shaft 43 penetrate and are rotatably supported by the frame 20. The cam member 42 has substantially a circular form excentric with the cam shaft 43. It has a recess, which is formed between a cam surface portion remotest from the center of eccentricity of the cam member 42 and a cam surface portion nearest to the excentricity center and constitutes part of the cam surface.

Figure 7:
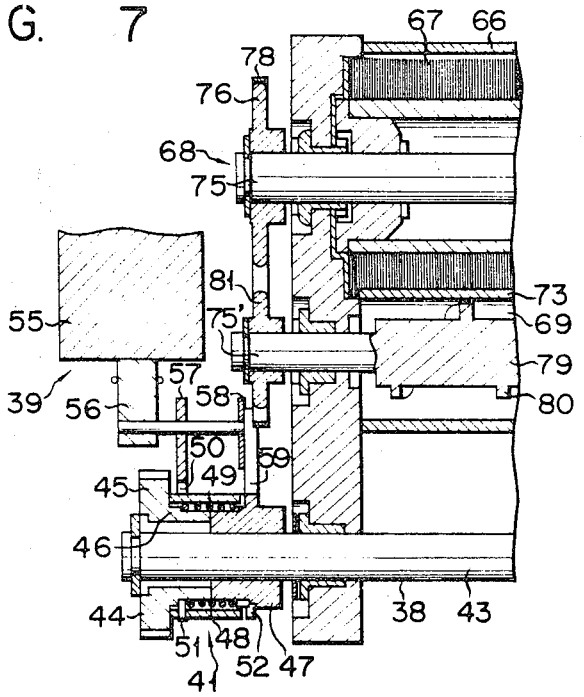
Figure 9:
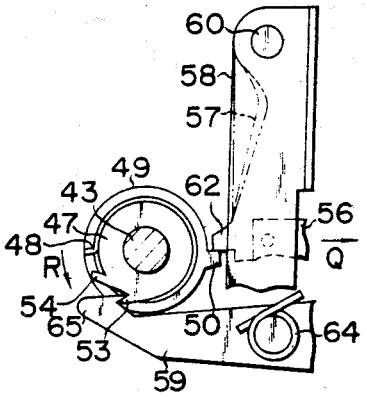
Figure 10:
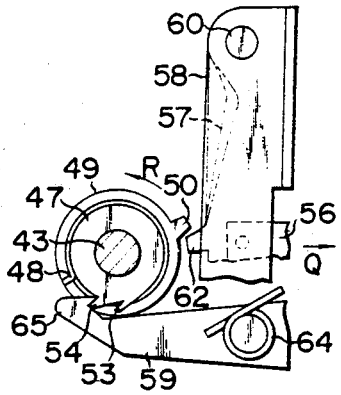

The spring clutch mechanism 41 is provided on that portion of the cam shaft 43 which is projecting from the frame 20 to the outside, as clearly shown in FIG. 7. This mechanism 41 includes a clutch gear 44 as a driving side rotatably mounted on the end of the cam shaft 43. The clutch gear 44 has a flange portion 45, which is provided with a gear intermeshing with the gear 40 driven by a drive source (not shown) for the drum 18, and also a cylindrical portion 46 integral with the flange portion 45. On the side of the clutch gear 44 nearer the frame 20, a cylindrical member 47 as a driven side of the spring clutch mechanism 41 is secured to the cam shaft 43. The outer diameter of the cylindrical member 47 substantially coincides with the outer diameter of the cylindrical portion 46 of the clutch gear 44. A spring 48 is provided over both the outer peripheries of the cylindrical portion 46 and cylindrical member 47. The spring 48 has the same direction of winding as a left hand screw, as shown in FIGS. 9 and 10. In FIG. 9, the clutch gear 44 is not shown but is assumed to be located on the side of the rearer, and restoring force is stored in the spring 48 with the counterclockwise rotation of the clutch gear 44. A sleeve 49 is provided on the outer side of the spring 48. The sleeve 49 has a projection 50 projecting from its outer surface and capable of engaging with a stopper 62 of a first solenoid level 57, which will be described hereinafter in detail, as need arises. The sleeve 49 is also formed adjacent to its end on the side of the clutch gear 44 with a groove or hole 51, in which one end of the spring 48 is fixed. The spring 48, which has its one end bent and retained in the hole 51 of the sleeve 49, has its other end bent to extend in the axial direction of the cam shaft 43 and retained in a groove 52 formed in the cylindrical member 47. The outer periphery of the cylindrical member 47 is provided with first and second pawls 53 and 54 spaced apart in the peripheral direction and serving as engagement pieces for engagement with a hook 65 of a hook member 59 which will be described later in detail.

Figure 8:
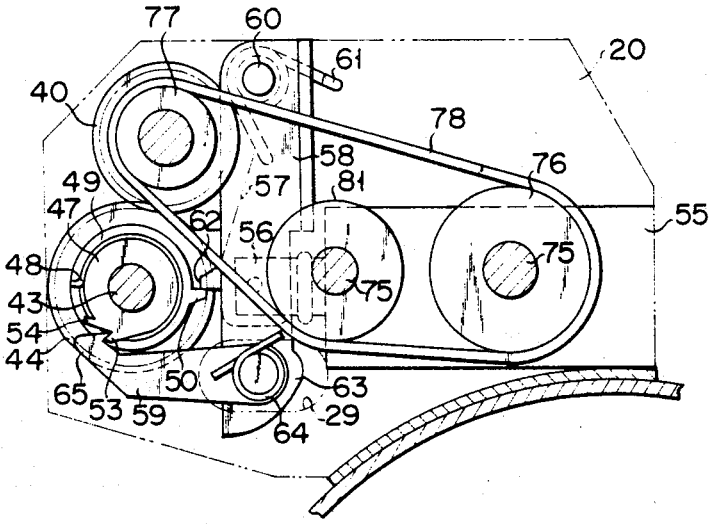

The timing control mechanism 39, as most clearly shown in FIG. 8, includes a solenoid 55 which is energized according to an output signal from a control circuit (not shown), a drive piece 56 extending through the solenoid 55 and movable between first and second positions, first and second solenoid levers 57 and 58 rotatably coupled to the drive piece 56 and the aforementioned hook member 59 which is coupled to the second solenoid lever 58.

When the solenoid 55 is energized, the drive piece 56 extending therethrough is moved to the right in the Figure.

The first and second solenoid levers 57 and 58, which are each pivoted at one end to the drive piece 56, have their other ends rotatably mounted on a shaft 60 secured to the frame 20, and they extend in a spaced-apart and parallel relation and ganged to each other. Both levers 57, 58 are biased by a spring 61 in the clockwise direction in the Figure, so that when the solenoid 55 is not energized the drive piece 56 which is coupled to the first and second solenoid levers 57 and 58 is held at a first postion. When the solenoid 55 is energized, the solenoid levers 57 and 58 are moved to the right in the Figure up to their second position against the biasing force of the spring 61. The first solenoid lever 57 has the afore-mentioned stopper 62 which is capable of engagement with the projection 50 of the sleeve 49. When the drive piece 56 is in the first position, the stopper 62 is found at a position within the range of movement of the projection 50 and stops the rotation of the sleeve 49 having the projection 50. The second solenoid lever 58 has an extension 63 extending downwards in the Figure. The end of the hook member 59 opposite the afore-mentioned hook 65 is pivoted to the lower end of the extension 63 and biased by a spring 64 in the clockwise direction. The other end portion of the hook member 59 extends below the cylindrical member 47 and is held in engagement with the outer periphery of the cylindrical member 47 by the spring 64. The hook 65 which is provided at the other end of the hook member 59 is capable of engagement with the first pawl 53 or second pawl 54. When the second solenoid lever 58 is moved to the second position with the energization of the solenoid 55, the hook 65 comes into engagement with the first pawl 53 or second pawl 54 to rotate the cylindrical member 47 in the clockwise direction in the Figure. It is to be noted here that the hook 65 and the pawls 53 or 54 have such shapes that they will not engage each other at the time when the cylindrical member 47 is rotated in the counterclockwise direction as shown by arrow R in the Figure.

The secured end poritions of the spring 48, the position of the projection 50 and the positions of the first and second pawls 53 and 54 are set in a predetermined relation to one another. More particularly, when the hook 65 of the hook member 59 engages the first pawl 53 of the cylindrical member 47 with the spring 48 in a state capable of transmitting drive force, the projection 50 of the sleeve 49 is found at a position below the stopper 62 of the first solenoid lever 57, and at the time when the hook 65 engages the second pawl 54 the projection 50 is found at a position above the stopper 62.

The toner recovery mechanism 24, as shown in FIGS. 4 and 7 or 8, includes a hollow housing 66 secured to the frame 20, a fur brush 67 disposed within the housing 66 and rotatably supported by the frame 20 for recovering the toner removed from the drum 18 by the cleaning blade 21, a fur brush drive mecahism 68 for driving the brush 67 and a toner container 69 for accommodating the recovered toner.

The housing 66 faces an upper portion of the surface of the photo-sensitive material coated drum 18, and includes an inner space 70 of a substantially cylindrical shape as will be described later in detail, a first opening 71 formed at a position near the tip of the cleaning blade 21 and a second opening 72 formed above and on the left side of the first opening 71. The fur brush 67 has a brush section for picking up the toner. The brush section consists of synthetic resin filaments or strings of 10 denier diameter (1 denier being about 1/100 mm). The synthetic resin may be a rayon fiber. Also, an acryl fiber is recommended from the standpoint of its charging property, i.e., readiness of separation of toner from it. The fur brush 67 is designed such that its outer peripheral portion lightly touches the tip of the cleaning blade 21 and the surface of the drum 18 for preventing the scattering of toner to the outside of the toner recovering mechanism 24, and also the brush outer periphery is formed to a circular profile with the axis of its rotation as the center. The fur brush 67 is rotated in the direction oppsite to the direction of rotation of the drum 18.

A portion 73 of the inner peripheral wall of the housing 66 constituting the edge of the second opening 72 on the side of the drum 18 is so formed that it has a rise which is gradually protruded inwardly of the housing 66. This inwardly protruded portion 73 of the inner peripheral wall extends into the fur brush 67 from the end thereof, so that a portion of the fur brush 67 engaging the protruded portion 73 is curved thereby. The peripheral wall of the housing 66 is also provided at other edge of the second opening 72 opposite the protruded portion 73 with a sharply bent portion or inward projection 74 projecting toward the center of the space 70.

As shown in FIGS. 7 and 8, a brush drive mechanism 68 for driving the fur brush 67 includes a shaft 75 carrying the fur brush 67 coaxially secured thereto at one end thereof and rotatably mounted in the frame 20, a first lader wheel 76 coaxially secured to other end portion of the shaft 75 outwardly projecting from the frame 20, a second ladder wheel 77 coaxially secured to the gear 40 and a ladder chain 78 passed round the first and second ladder wheels 76 and 77 for power transmission between these ladder wheels 76 and 77. The diameters of the first and second ladder wheels 76 and 77 are set such that the peripheral speed of the end of the brush 67 coincides with the peripheral speed of the surface of the drum 18 so that the recovered toner will not become smoky in the neighborhood of the first opening 71.

As shown in FIGS. 4 to 8, the toner container 69 for accommodating the toner recovered by the fur brush 67 includes a toner recovery auger 79 disposed adjacent to the second opening 72, and a pipe (not shown) connecting the toner recovery auger 79 and a toner replenishment port of a developing device (not shown). The toner recovery auger 79 has an inner rotatable helical blade 80 which is secured to a shaft 75' rotatably mounted in the frame 20. A third ladder wheel 81 is coaxially secured to an end portion of the shaft 75' outwardly projecting from the frame 20. As shown in FIG. 8, the ladder chain 78 is passed round the third ladder wheel 81 so that the ladder wheel 81 is rotated by the ladder chain 78.

Figure 5:
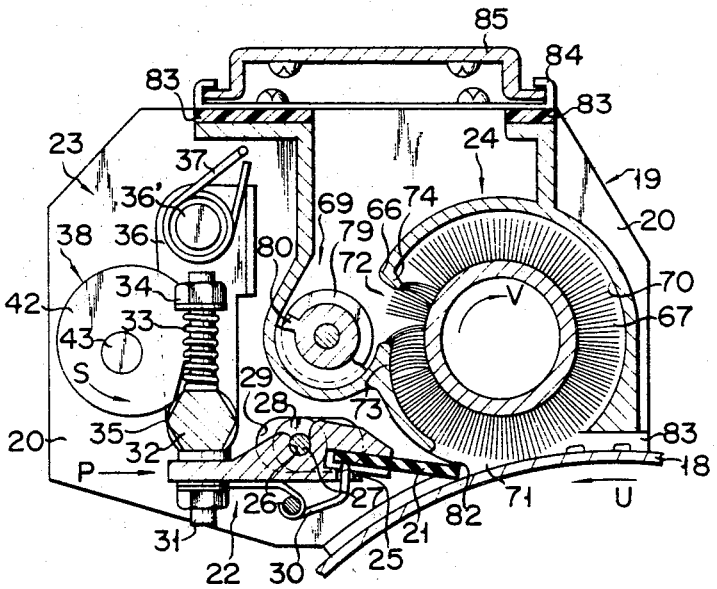
Figure 6:
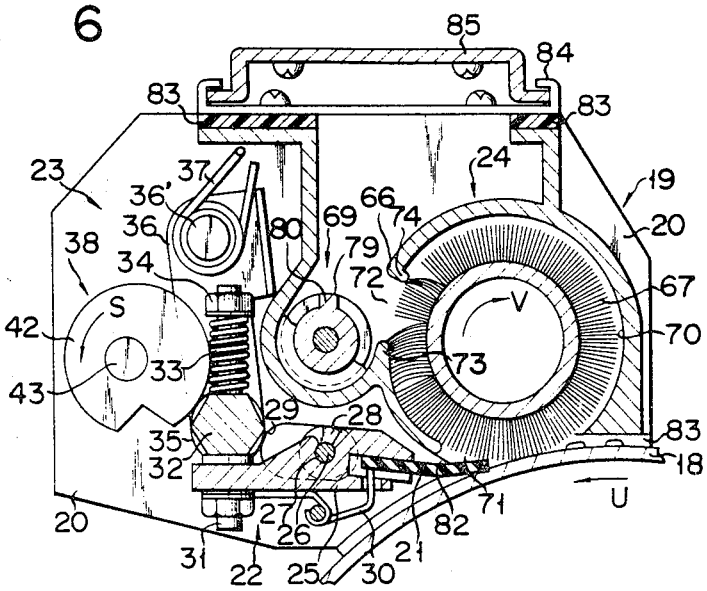

As shown in FIGS. 4 to 6, a mylar film 82 having elasticity is bonded to a portion of the surface of the housing 66 adjacent to the first opening 71, i.e., a portion of the housing 66 in the neighborhood of the cleaning blade 21. The mylar film 82 is provided for preventing the formation of a gap between the cleaning blade 21 and housing 66 at the time when the cleaning blade 21 is moved to the right direction in the Figure into contact with the surface of the photo-sensitive material coated drum 18. The outer surface of the housing 66 is also provided on the side of the first opening 71 opposite the mylar film 82 with a scattering prevention member 83 which serves to prevent the toner inside the drum cleaning apparatus 19 from scattering to the outside thereof.

The frame 20 of the drum cleaning apparatus 19 is provided with a guide 84. The drum cleaning apparatus 19 is installed on the copying machine coupling the guide 84 to a rail 85 provided on the frame of the copying machine.

The operation of the photo-sensitive material coated drum cleaning apparatus of the above construction will now be described.

When the copying machine is out of operation, the cam member 42 is held at the position, at which the bush rollers 35 can enter the recess of the cam plate 42, as shown in FIG. 4. Since the bush roller 35 is biased by the spring 37 in the clockwise direction with respect to the shaft 36', it is held in engagement with the recess of the cam member 42, so that the cleaning blade 21 is spaced apart from the surface of the photo-sensitive material coated drum 18 at this time. Also at this time, the solenoid 55 is not energized, so that no magnetic force is acting upon the drive piece 56. Thus, the drive piece 56 and first and second solenoid levers 57 and 58 are held at a first position shown by broken and solid lines in FIG. 10 by the clockwise biasing force of the spring 61. Further, the sleeve projection 50 of the sleeve 49 and the second pawl 54 of the cylindrical member 47 are held in their respective positions determined by the cam member; namely the former is held at a position above the stopper 62 of the first solenoid lever 57, and the latter is held at a position in engagement with the hook 65 of the hook member 59 of coupled to the second solenoid lever 58.

In this inoperative state of the copying machine, by operating a print switch (not shown) of the copying machine a copying operation is started.

When the copying operation is started, the solenoid 55 is temporarily energized immediately before the drive mechanism for the photo-sensitive material coated drum 18 is operated by an output signal from the control circuit (not shown). With the energization of the solenoid 55 the drive piece 56 receives a magnetic force tending to move it in the direction of arrow Q in FIG. 10. As a result, the drive piece 56 and the first and second solenoid levers 57 and 58 coupled thereto are slightly rotated about the shaft 60 in the counterclockwise direction against the clockwise biasing force of the spring 61 to the second position as shown by two dots dash lines. With this slight rotation of the second solenoid lever 58 the hook member 59 which is coupled thereto is slightly moved in the direction of arrow Q, so that the cylindrical member 47, the second pawl 54 of which is in engagement of the hook 65 of the hook member 59, is slightly rotated in the direction of arrow R, i.e., in the counterclockwise direction. With the slight rotation of the cylindrical member 47, the cam member 42 is slightly rotated in the direction of arrow S in FIG. 4, i.e., in the counterclockwise direction. With the slight rotation of the cam member 42, the bush rollers 35 are slightly moved in the direction of arrow P in the Figure by the cam surface of the cam member 42. As a result, the tip of the cleaning blade 21 is brought to a position in light contact with the surface of the photo-sensitive material coated drum 18, as shown in FIG. 5.

In this state, the temporary excitation of the solenoid 55 is released, whereupon the first and second solenoid levers 57 and 58 are returned to their respective first positions shown by broken and solid lines by the biasing force of the spring 61. With the restoration of the solenoid levers, the stopper 62 of the first solenoid lever 57 is brought to a position within the movable range of the projection 50 of the sleeve 49, and also the hook member 59 is returned to its first position shown by solid line.

Subsequently, rotation of the drum 18 is caused by the drive source (not shown). The drive force from the drive source is transmitted to the gear 40 shown in FIG. 8 to cause rotation thereof, thus causing rotation of the clutch gear 44, which is intermeshing with the gear 40, in the counterclockwise direction shown by arrow R in the Figure. In accordance with rotation of the clutch gear 44, the sleeve 49 is rotated in the direction of arrow R together with the spring 48, which has its one end secured in the groove 52 of the cylindrical member 47. The rotation of the clutch gear 44 is thus transmitted to the cylindrical member 47, causing further rotation of the cam member 42 from the position thereof shown in FIG. 5 in the direction of arrow S. With this rotation, the portion of the cam surface of the cam member 42 that is in engagement with the bush rollers 35 is gradually moved away from the center of rotation of the cam member 42, so that the cleaning blade 21 is further moved gradually in the direction of arrow S. This means that the tip of the cleaning blade 21 is gradually pressed against the surface of the photo-sensitive drum 18.

When the portion of the cam surface 42 that is in engagement with the bush rollers 35 reaches a position remotest from the center of rotation of the cam member 42 as shown in FIG. 6, that is, when the cleaning blade 21 is brought to a state capable of cleaning the surface of the drum 18, the projection 50 of the sleeve 49 is brought into engagement with the stopper 62 of the first solenoid lever 57 as shown by solid and broken lines in FIG. 9 to stop the rotation of the sleeve 49. This results from the afore-mentioned positional relation between the cam member 42 and the projection 50 of the sleeve 49. With the stopping of rotation of the sleeve 49 the rotation of the clutch gear 44 is no longer transmitted to the cylindrical member 47, so that the rotation of the cam member 42 is stopped. This means that the tip of the cleaning blade 21 now remains urged against the surface of the drum 18, that is, is held in a state ready for cleaning as shown in FIG. 6. In the state shown in FIG. 9, the hook 65 of the hook member 59 is capable of engagement with the first pawl 53 of the cylindrical member 47.

In this state, where the pressure exerted to the surface of the drum 18 by the tip of the cleaning blade 21 exceeds a predetermined value, the support 25 is rotated about the roller shaft 27 in the counterclockwise direction in the Figure against the biasing force of the compression spring 33 unitl the pressure is reduced to the predetermined value. Thus, the pressure exerted to the surface of the drum 18 by the tip of the cleaning blade 21 is always held at a desired constant value.

The tooth numbers and pitch diameters of the clutch gear 44 and gear 40 are set such that the period required for bringing the cleaning blade 21 from the state of FIG. 5 to the state of FIG. 6, i.e., the period required for bringing the cleaning blade 21 from the state in light contact with the surface of the drum 18 to the state ready for cleaning, is equal to the period required until the peripheral speed of the surface of the drum 18 reaches a constant value.

In the state of FIG. 6, the photo-sensitive material coated drum 18 continues its rotation, so that a portion of the surface of the drum 18 having passed by over image forming and transferring process sections (not shown) reaches the cleaning blade 21. Thus, the residual toner still remaining left on that surface portion of the drum 18 is removed by the cleaning blade 21, whereby the surface of the drum 18 is cleaned.

Meanwhile, the drive force from the drive source is transmitted to the fur brush drive mechanism 68, so that the fur brush 67 is rotated in the clockwies direction in the Figure. Since the peripheral speed of the end of the brush 67 is set equal to the peripheral speed of the surface of the photo-sensitive material coated drum 18, the end of the fur brush 67 reliably picks up the toner collected at the tip of the cleaning blade 21 and raises the picked-up toner up to the second opening 72 as it moves in frictional contact with the inner peripheral wall surface of the housing 66. Since the brush hair of the fur brush 67 has elasticity, it is curved by the gradually inwardly protruded portion 73 of the housing 66 before reaching the second opening 72. As it reaches the second opening 72, the curved brush hiar is released, whereby it releases the toner attached to it, and as it subsequently strikes the projection 74 the toner remaining in it is completely thrown away from it. In this way, the toner picked-up by the end of the brush 67 is transferred to the toner container 69, and the end of the brush 67 again becomes ready for recovery of toner.

The toner dropped into the toner container 69 is collected in the toner recovery auger 79. The collected toner is transferred to the toner replenishment port of the developing device (not shown) and repeatedly used as developer.

In the above way, the cleaning of the surface of the photo-sensitive material coated drum 18 is effected.

When the copying operation is ended, the drive source (not shown) for the drum 18 is stopped. As a result, each rotation of the drum 18, brush 67, clutch gear 44 and toner recovery unit 79 is stopped. Immediately after this, the solenoid 55 is energized again, whereby the drive piece 56 and first and second solenoid levers 57 and 58 are moved from their respective first positions shown by broken and solid lines in FIG. 9 to the second positions shown by two dots dash lines in the direction of arrow Q. With this movement, the stopper 62 of the first solenoid lever 57 is brought out from its position of blocking the movement of the projection 50 of the sleeve 49, and the hook member 59 coupled to the second solenoid lever 58 is slightly moved toward said second position in the Figure with a result that the cylindrical member 47 is rotated by engagement of the hook 65 at the end of the hook member 59 with the first pawl 53 of the cylinderical member 47 in the direction of arrow R. As a result, the cam shaft 43 and cam member 42 are slightly rotated in the direction of arrow S, so that the recess of the cam member 42 is brought to the position, at which the buch rollers 35 can be received in the recess. Since the bush rollers 35 are biased in the clockwise direction in the Figure by the spring 37, the bush rollers 35 are moved by a large distance in the direction opposite to the direction of arrow P until they are engaged in the recess of the cam member 42. That is, the cleaning blade 21 is separated from the surface of the photo-sensitive material coated drum 18.

Meanwhile, with the rotation of the cam shaft 43, the projection 50 of the sleeve 49 is rotated in the direction of arrow R from the position shown in FIG. 9 to the position shown in FIG. 10.

Subsequently, the solenoid 55 is de-energized, whereby the first and second solenoid levers 57 and 58 are moved back to their first positions shown in FIG. 10. In other words, the hook 65 of the hook member 59 is brought into engagement with the second pawl 54 of the cylindrical member 47, while the stopper 62 of the first solenoid lever 57 is brought to the position of blocking the movement of the projection 50 of the sleeve 49.

As has been described in the foregoing, with the aforementioned embodiment of the invention the cleaning blade 21 is held spaced apart from the photo-sensitive material coated drum 18 when placed under the inoperative state of the copying machine, so that the crystal change of the surface of the drum 18 that may occur when if the cleaning blade 21 is held pressed thereagainst at all times is prevented so as not to deteriorate the image quality. In addition, since the cleaning blade 21 is first brought to light contact with the drum surface by the cam mechanism 38 at the time of the commencement of the cleaning and then gradually urged against the surface of the drum 18 to a state ready for cleaning before the peripheral speed of the drum 18 reaches a predetermined value, there is no possibility for the tip of the cleaning blade 21 to be damaged, so that the life of the cleaning blade can be extended. Further, the cleaning blade 21 is brought into light contact with the drum 18 before the driving thereof and separated therefrom after the stopping thereof by using the solenoid 55 which is temporarily energized. Thus, unlike the prior-art apparatus there is no possibility for the toner which remains on the surface of the drum 18 having cleared the tip of the cleaning blade 21 before the blade 21 is brought into contact with the drum 18 immediately after the driving thereof to be scattered and contaminate the charger and various other mechanisms of the copying machine. Also, since the solenoid 55 is temporarily energized, power is consumed temporarily, which is economical. Furthermore, the toner collected at the tip of the cleaning blade 21 can be completely recovered in the recovered toner container 69, this is disposed above the drum 18, by the fur brush 67 having elasticity. Thus, it is possible to meet the design demand for miniatuarizing the copying machine and also prevent otherwise liable contamination of the inside of the copying machine by non-recovered toner remaining on the cleaning blade 21 or in the neighborhood of the recocvered toner container 69.

Figure 11A:
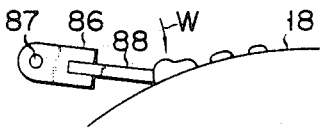
FIGS. 11A to 11C show fragmentary side views showing another embodiment of the apparatus for cleaning a photo-sensitive body according to the invention.
Figure 11B:
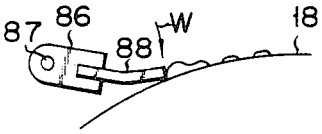
Figure 11C:
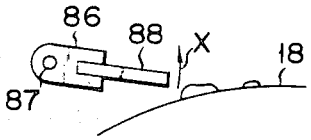

It is to be understood that the above embodiment is by no means limitative and various changes and modifications are possible without departing from the scope and spirit of the invention. For example, it is possible to freely select the shape of the cam mechanism 38, material of the fur brush 67 and shape of the gradually inwardly protruded portion 73 of the peripheral wall of the housing 66. Also, the movement of the cleaning blade 21 is not limited to a linear one, unlike that in the above embodiment. For example, the cleaning blade may be rotatably provided as shown in FIGS. 11A to 11C. In this example, a cleaning blade 88 is mounted in a blade holder mechanism 86 for rotation in unison therewith about a shaft 87. The rotation of the blade holder mechanism 86 in unison with the cleaning balde 88 in the directions of arrows W and X in the Figures is controlled by a cam mechanism (not shown). Immediately before the start of rotation of the photo-sensitive material coated drum 18, the cam mechanism causes rotation of the cleaning blade 88 in the direction of arrow W into light contact with the surface of the drum 18. Subsequently, when the rotation of the drum 18 is started, the cleaning blade 88 is further gradually rotated in the direction of arrow W and thus gradually pressed against the surface of the drum 18 to a state ready for cleaning until the peripheral speed of the drum 18 reaches a predetermined value. In this state, the surface of the drum 18 is cleaned by the cleaning blade 88. When the rotation of the drum 18 is stopped, the cam mechanism drives the cleaning blade 88 in the direction of arrow X to separate the blade 88 from the surface of the drum 18.

What is claimed is:

1. A method of cleaning toner from a surface of a photo-sensitive body after transfer of an image from said body comprising the steps of:

(a) bringing a cleaning blade into contact with said surface at a first contact pressure when said body is stationary;

(b) rotating said body and monotonically increasing the speed of rotation thereof to a predetermined speed;

(c) monotonically increasing the contact pressure while the speed of said body is being increased, so that the contact pressure reaches a maximum contact pressure when the speed of rotation of said body reaches said predetermined speed; and (d) maintaining said maximum contact pressure while said body continues rotating at said predetermined speed, so that said blade moves toner from said surface.

2. A method according to claim 1 further comprising the steps of:

(e) stopping motion of said body; and (f) removing contact between said cleaning blade and said surface.

3. A method according to claim 1 wherein step (a) comprises the step of bringing said cleaning blade into contact with said surface with a translational movement of said cleaning blade.

4. A method according to claim 1 wherein step (a) comprises the step of bringing said cleaning blade into contact with said surface with a rotational movement of said cleaning blade.

5. A method according to claim 2 further comprising the step of:

(g) recovering toner cleaned from said surface.

* * * * *